United States Patent [19]

Johnson, Jr.

[11] 4,219,913

[45] Sep. 2, 1980

[54] ASSEMBLY MACHINE

[75] Inventor: Keith Johnson, Jr., Sporting Hill, Pa.

[73] Assignee: AMP Incorporated, Harrisburg, Pa.

[21] Appl. No.: 934,740

[22] Filed: Aug. 21, 1978

[51] Int. Cl.[2] ..... H01R 43/00

[52] U.S. Cl. ..... 29/33 M; 29/564.1; 29/566.1; 29/749

[58] Field of Search ..... 29/564.1, 566, 566.1, 29/566.3, 748, 759, 749, 33 M

[56] References Cited

U.S. PATENT DOCUMENTS

| | | | |
|---|---|---|---|
| 2,778,097 | 1/1957 | Berg | 29/33 M X |
| 2,873,511 | 2/1959 | Folkenroth | 29/33 M X |
| 3,114,828 | 12/1963 | Gannoe | 29/33 M X |
| 3,777,349 | 12/1973 | Barnes | 29/564.1 X |
| 3,848,316 | 11/1974 | Bakermans et al. | 29/564.1 X |
| 4,137,624 | 2/1979 | Davis et al. | 29/566.1 |

*Primary Examiner*—William R. Briggs

*Attorney, Agent, or Firm*—Allan B. Osborne

[57] ABSTRACT

This invention relates to a machine for joining a cap and base to form a modular telephone plug and terminating the wires therein. The machine includes mechanisms for advancing the strip-mounted cap to the work area, severing it from the strip, clamping and dressing the wires across the cap, means for placing the base onto the cap and welding the two together, mechanism for clamping the welded plug while other mechanisms trim the ends of the wires protruding from the front of the plug and fully insert terminals which had been partially inserted into the cap.

3 Claims, 17 Drawing Figures

ASSEMBLY MACHINE

BACKGROUND OF THE INVENTION

1. Field of the Invention

This invention is related to machines such as those which assemble or join two piece electrical connector housings and terminate electrical wires therein.

2. Prior Art

Modular telephone plugs currently in use are molded as a single or one piece housing. Accordingly, as far as is known, the need for a machine to join a two-piece modular plug together has not existed prior to the invention and development of the two-piece modular plug described in U.S. Application, Ser. No. 900,468, which was filed on Apr. 27, 1978.

SUMMARY OF THE INVENTION

The present invention discloses a machine for welding the cap and base of a modular telephone plug together with the telephone wires therein between and inserting four terminals into the wires. Mechanisms on the machine include a feed unit which advances a cap to the work area and severs it from its carrier strip. A second unit clamps the telephone cord in place. Subsequent to the base being ultra-sonically welded to the cap, a plug clamp unit holds the welded plug in place while a fourth unit drives terminals into the wires and trims the wire ends protruding from the front of the plug.

DESCRIPTION OF THE INVENTION

The Modular Plug

Figure 1:
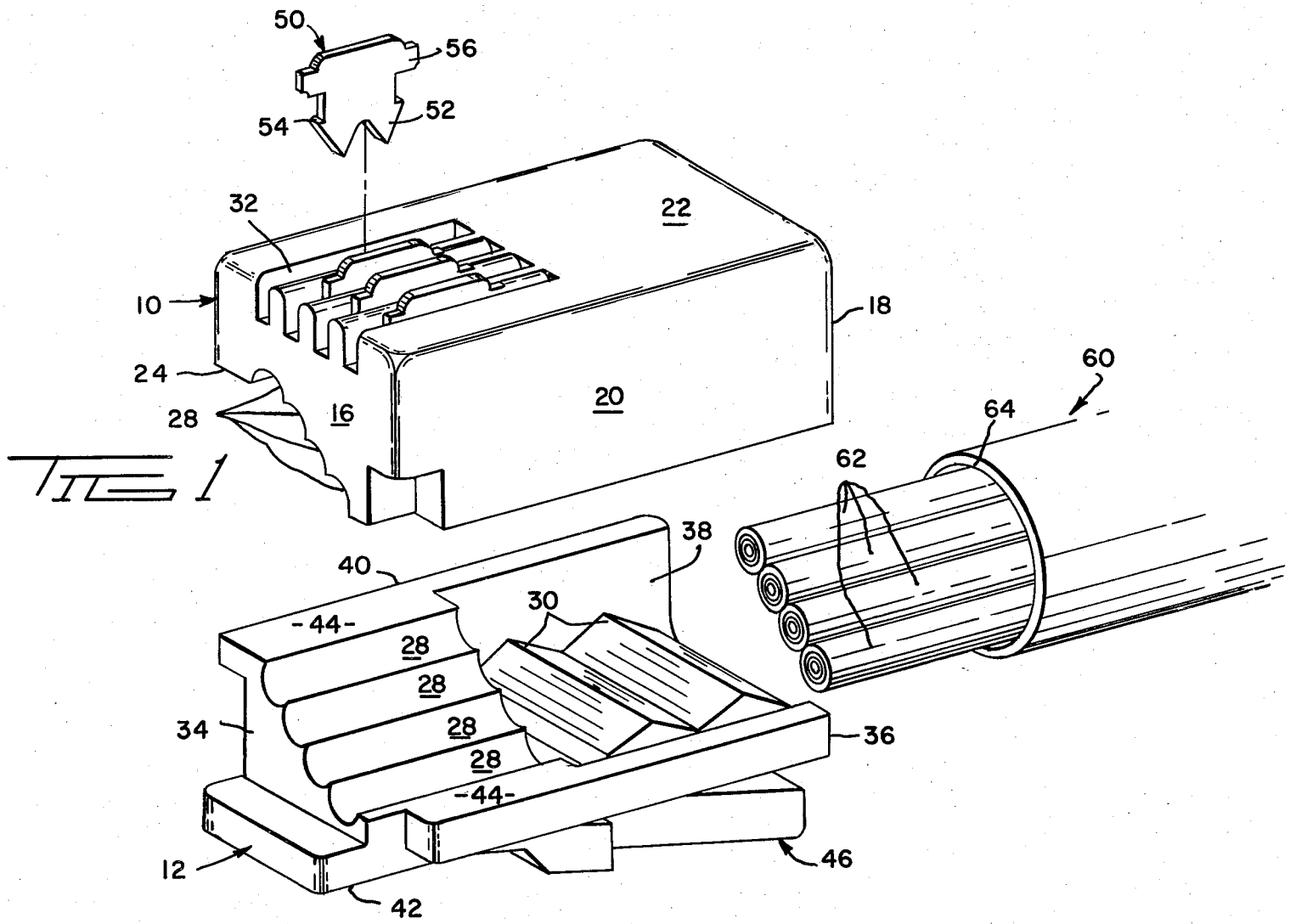
FIG. 1 shows the two piece modular plug, terminals and wires which are to be assembled in the machine of the present invention.

FIG. 1 shows the two-piece modular plug prior to its being welded together, a terminal and the wires to be terminated in the plug. Reference numeral 10 indicates the cap and reference numeral 12 indicates the base of the plug. Both pieces are separately molded on strip from polycarbonate. Other insulating materials may be used however. Although both pieces may be molded by a continuous molding process such as disclosed in U.S. Pat. No. 4,080,148, the most efficient use of the machine of the present invention requires that cap 10 be molded on a continuous carrier strip 14 shown in FIGS. 2 and 3.

Figure 7:
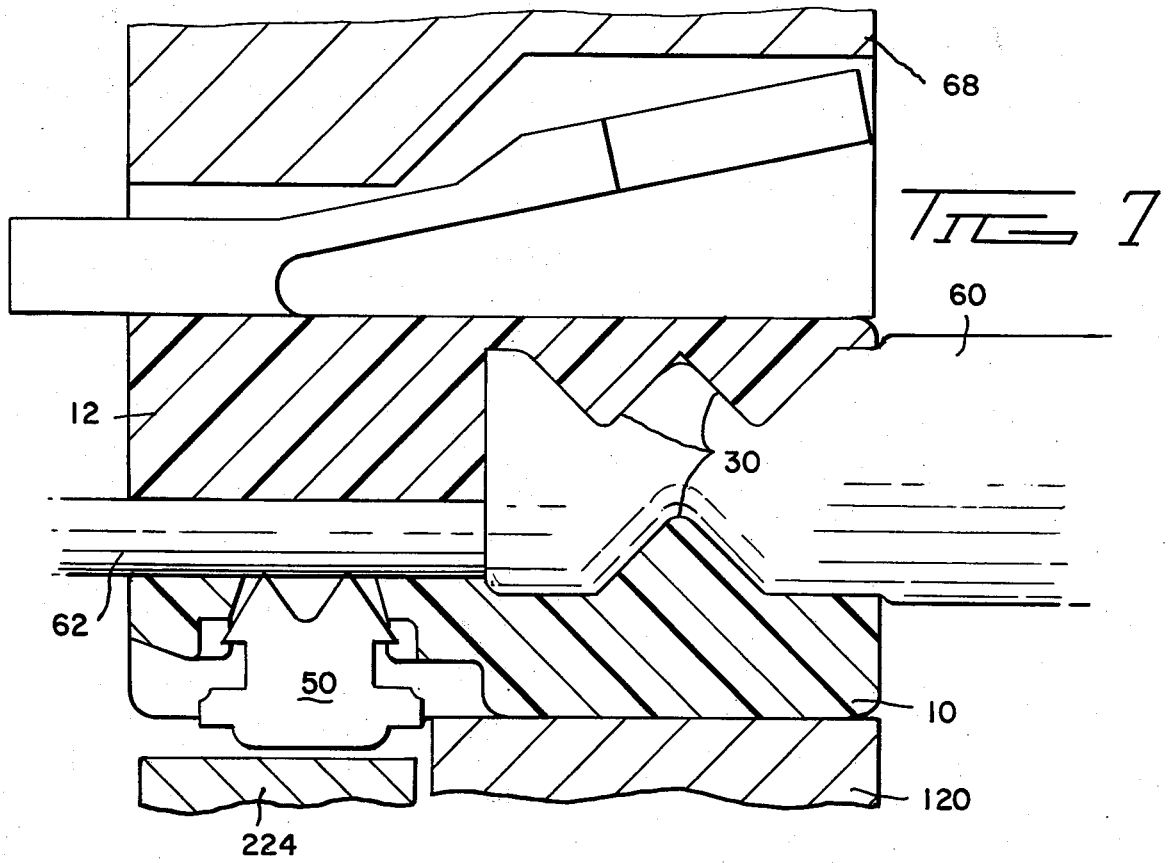

Cap 10 is axially elongated and has front face 16, rear face 18, side wall 20, upper surface 22 and lower surface 24 (not shown). The lower surface is almost the mirror image of the upper surface 40 of base 12; i.e., four axially extending grooves 28 are located on an inclined plane in front portion and strain relief teeth 30 are located in the back portion. The difference is that cap 10 has just one tooth 30 that meshes between the two teeth in the base when the two pieces are joined (FIG. 7).

Four slots 32 extend through the cap from its upper surface 22 to intersect the aforementioned grooves 28.

Base 12 with the same overall dimensions as cap 10, has a front face 34, rear face 36, side wall 38, upper surface 40 and lower surface or floor 42. As noted above, surface 40 has four grooves 28 and teeth 30. Further, ledges 44 are on the sides of both surface 40 and lower surface 24 on cap 10 (not shown).

A locking latch 46 is located on the floor 42 of the base.

Each plug receives four terminals 50, one of which is shown exploded out of a slot 32. These terminals are stamped and formed from coplanar strips (not shown) of conductive material such as a copper alloy. Each terminal has two, insulation-piercing tongs 52, barbs 54 and ears 56. As the distance from the cap's upper surface 22 to the underlying grooves increase due to the inclined lower surface, each of the four terminals are sequentially longer. The increase in length is taken up by the midsection of the terminal; i.e., that portion between barbs 54 and ears 56.

The telephone cord 60 to be terminated in the plug via the machine of the present invention is shown to the right in FIG. 1. This cord has four, separately insulated wires 62 surrounded by insulation jacket 64. Other types of cord such as a flat cord (not shown) may also be terminated in the plug via the present machine.

The Assembly

Figure 12:
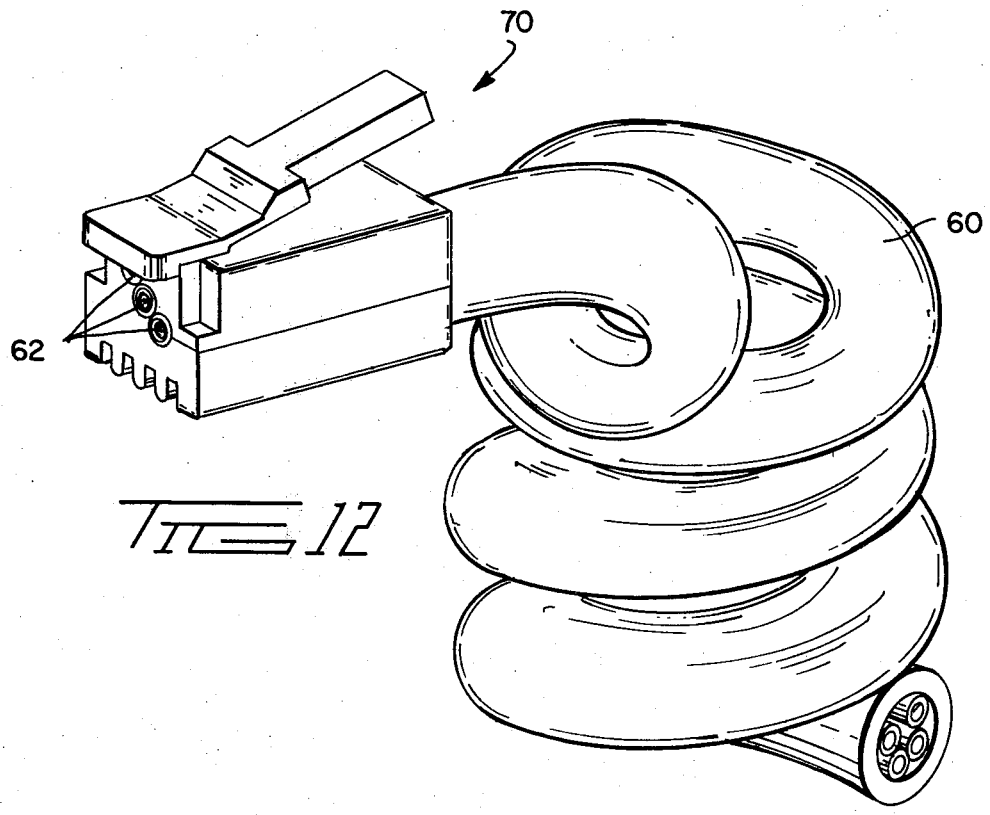
FIG. 12 shows the assembled plug.

FIGS. 2–10 show generally the stages in terminating wires 62 and bonding cap 10 and base 12 together to form the finished product, plug 70, shown in FIG. 12. Much of the details have been omitted from the figures so as to more clearly show the several operations. For the same reason parts of the machine are shown disassociated. Although the sequence of steps are being shown starting with FIGS. 2 and 3, the fact is that these two steps are the last to be performed. The reasoning therefore will be explained below.

Figure 2:
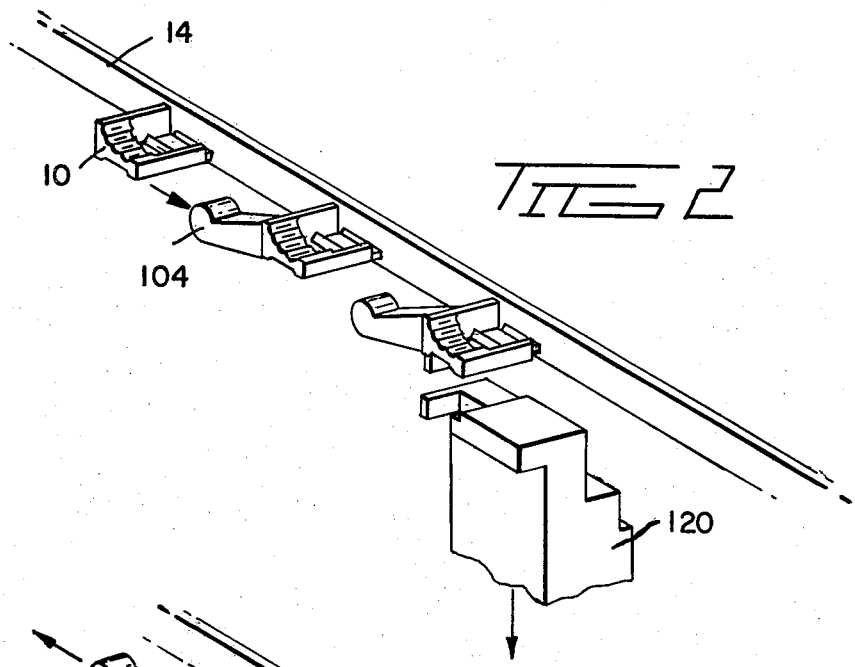
FIGS. 2 through 11 shows in general the several steps involved in assembling the modular plug.

In FIG. 2 caps 10, integrally joined to carrier strip 14 are being advanced towards elevator member 120 by pawls 104. The caps are upside down relative to the orientation in FIG. 1 and further terminals 50 have been partially inserted into slots 32 (FIG. 7).

The upper surface of the elevator member has a notch and the cap is properly positioned thereon when the notch is in alignment with the four slots. The cap is wedged into the notch slightly to hold it there.

Figure 3:
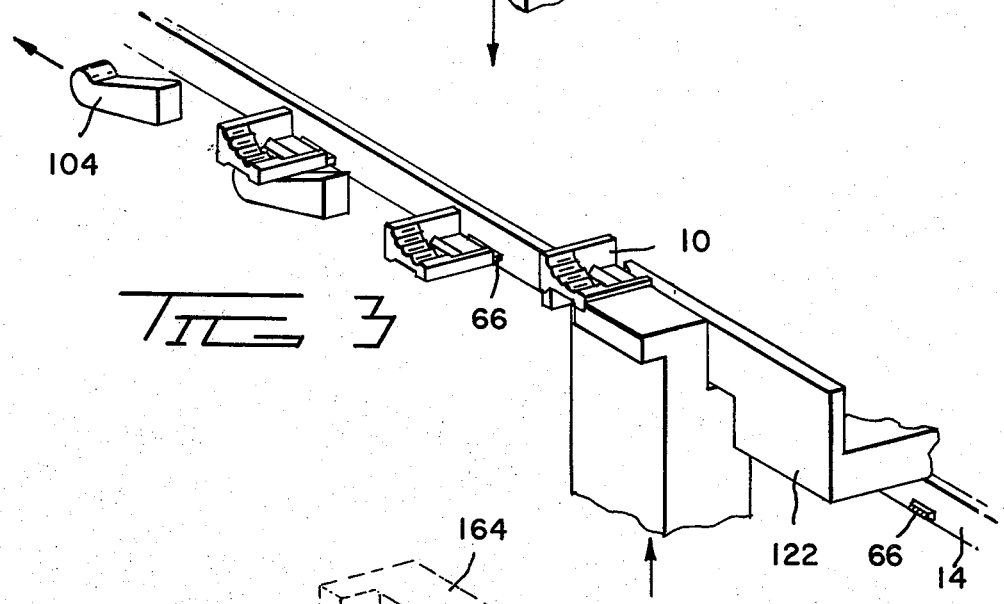

As can be seen in FIG. 3, a stationary knife blade 122 having its cutting edge on the bottom is located alongside the elevator. After a cap is positioned on top, the elevator member rises. The blade intercepts and severs strap 66 holding the cap to strip 14. Pawls 104 have been withdrawn to engage succeeding caps. Carrier strip 14 continues on out of the machine.

Figure 4:
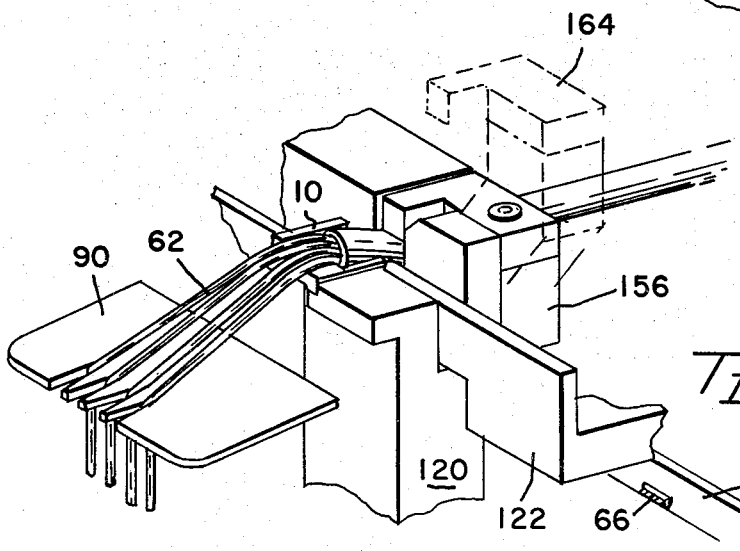

Referring now to FIG. 4, it is seen that wires 62 of cord 60 have been laid across the cap and wire clamp 164 depressed to hold the cord in place. The wires are now dressed into wire comb 90. The dressing aligns the individual wires along grooves 28 in the cap. Note the cord, including its insulation 64, is positioned in the cap's back portion across its one tooth 30. The positioning of the cord and its wires is done manually.

Figure 5:
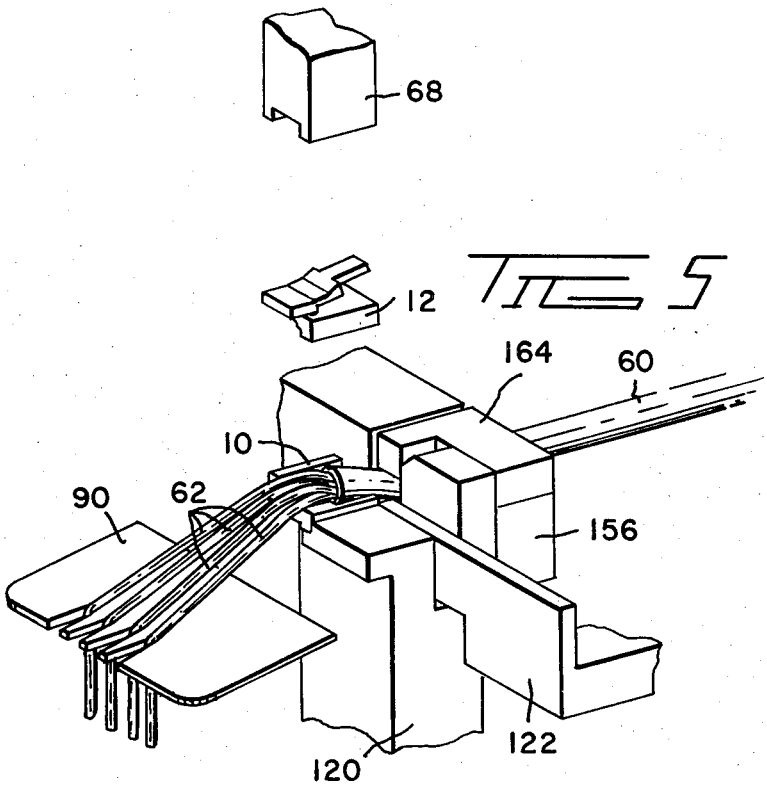

The operator next places a base 12 of the plug into the lower end 68 of an ultrasonic welding horn (not shown). As seen in FIG. 5, the base is inserted into the lower end with its locking latch facing upwardly. Vacuum holds the base in the lower end.

Thereafter the operator pushes two palm switches (not shown) and the remaining steps are done automatically.

Figure 6:
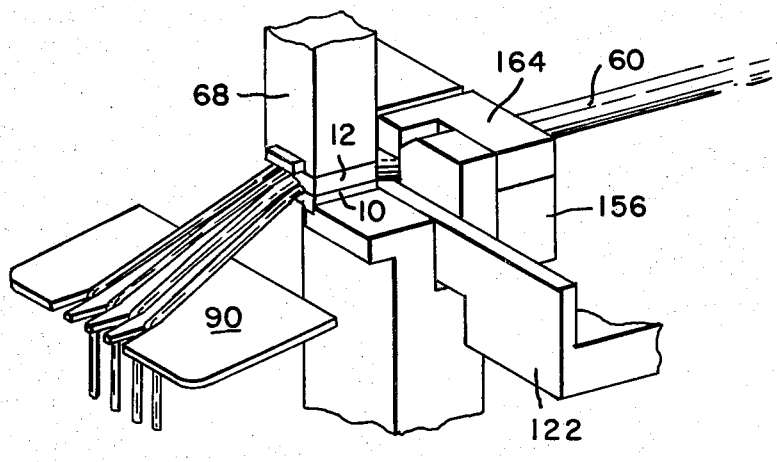

FIG. 6 shows the ultrasonic horn being lowered, placing base 12 onto cap 10 and welding the two together by ultrasonic means to form plug 70. FIG. 7 shows an enlarged cross-sectional view of this step.

Figure 9:
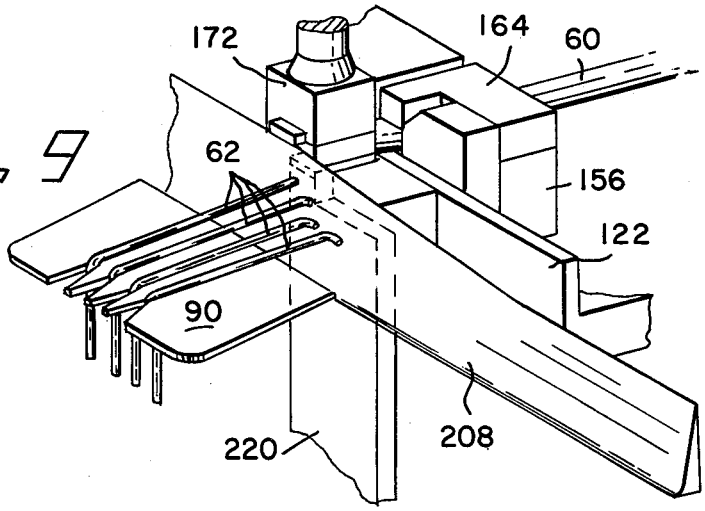

Subsequent to the welding step, the horn is withdrawn and pressure pad 172 swings over to take its place for the purpose of holding the plug down against elevator member 120. Thereafter, an inserter or anvil 224 rises from below to insert terminals 50 fully into slots 32 and into wires 62. Simultaneously trim blade 208 is sliding across the front of the plug severing the ends of wires 62 as seen in FIG. 9.

Figure 10:
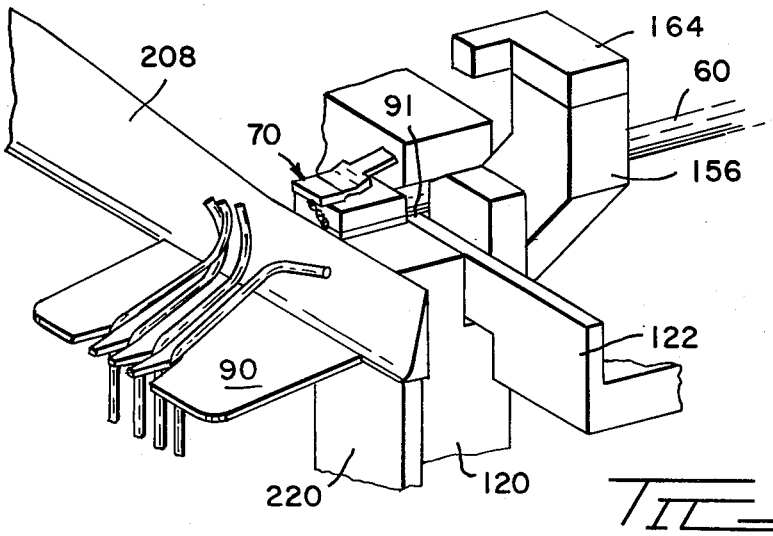

FIG. 10 shows the withdrawal of blade 208, pressure pad 172 and anvil 224. Also wire clamp 164 is removed to release plug 70 and its terminated cord from the machine.

Figure 11:
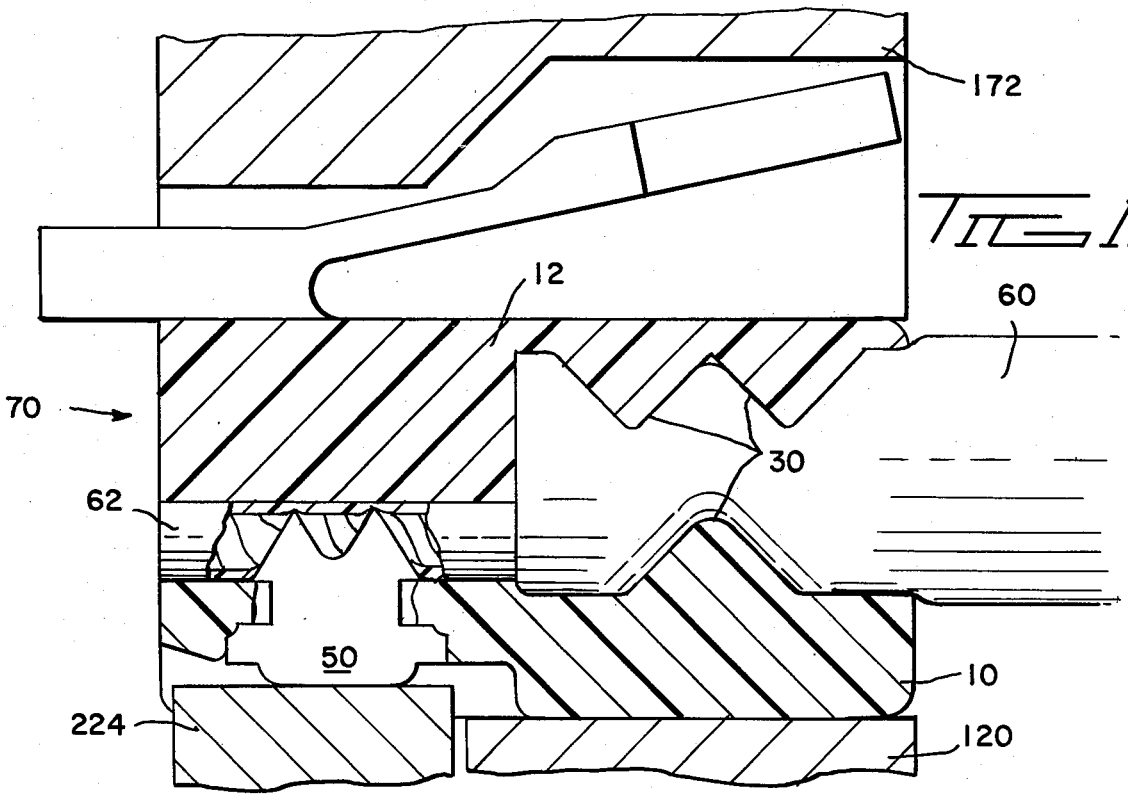

FIG. 11 is an enlarged cross-sectional view of plug 70 subsequent to the wires being severed and the terminals being inserted. FIG. 12 shows the assembled plug and cord 70.

Description of the Machine

Figure 13:
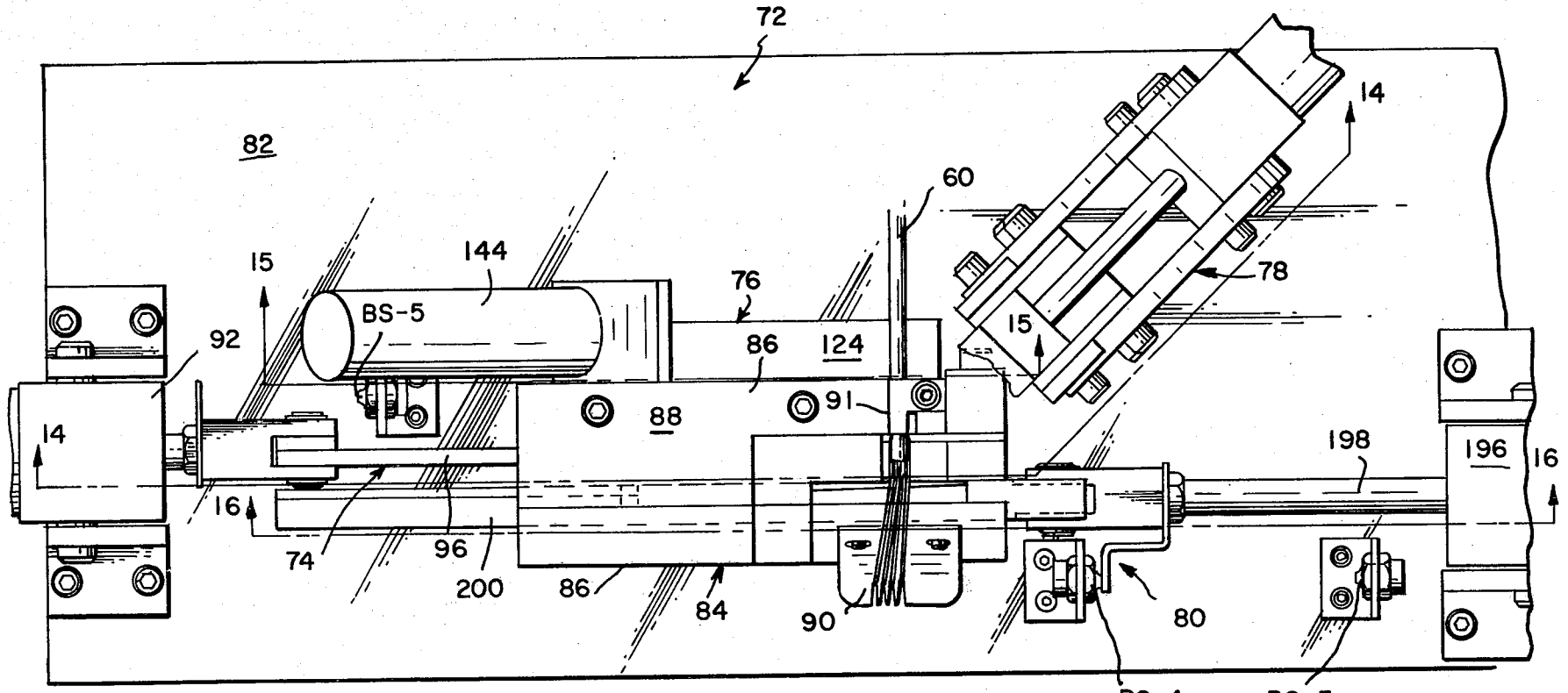
FIG. 13 is a top plan view of the assembly machine of the present invention.

FIG. 13 is a view looking down on top of machine 72, constructed in accordance with the preferred embodiment of the present invention. The machine is composed of four units as follows:

1. Feed Unit 74;
2. Wire-Clamp Unit 76;
3. Plug Clamp Unit 78; and
4. Inserter-Trim Unit 80.

The listing of the units follows the sequence of operations set forth above and as shown in FIGS. 2 through 11.

Machine 72 is mounted on any convenient base 82 which in turn is located on a bench or table (not shown).

Each of the four units have individual driving means which in the preferred embodiment are air operated, double valve, piston-containing cylinders. Of course other driving means may be used.

Shrouding for the machine may be as elaborate or minimal as desired, keeping OSHA regulations in mind. As such shrouding does not form part of the present invention, only the structural members thereof are shown; i.e., those pieces which support some of the working members. Thus, in FIG. 13, reference numeral 84 indicates a structure having side walls 86 and a cover plate 88. The end walls (not shown) have slots. The interior of the side walls have vertical grooves to support vertically sliding members. Wire comb 90 is mounted on the structure in front of wire support area 91. A track 93 is located along one side wall to receive carrier strip 14.

Figure 14:
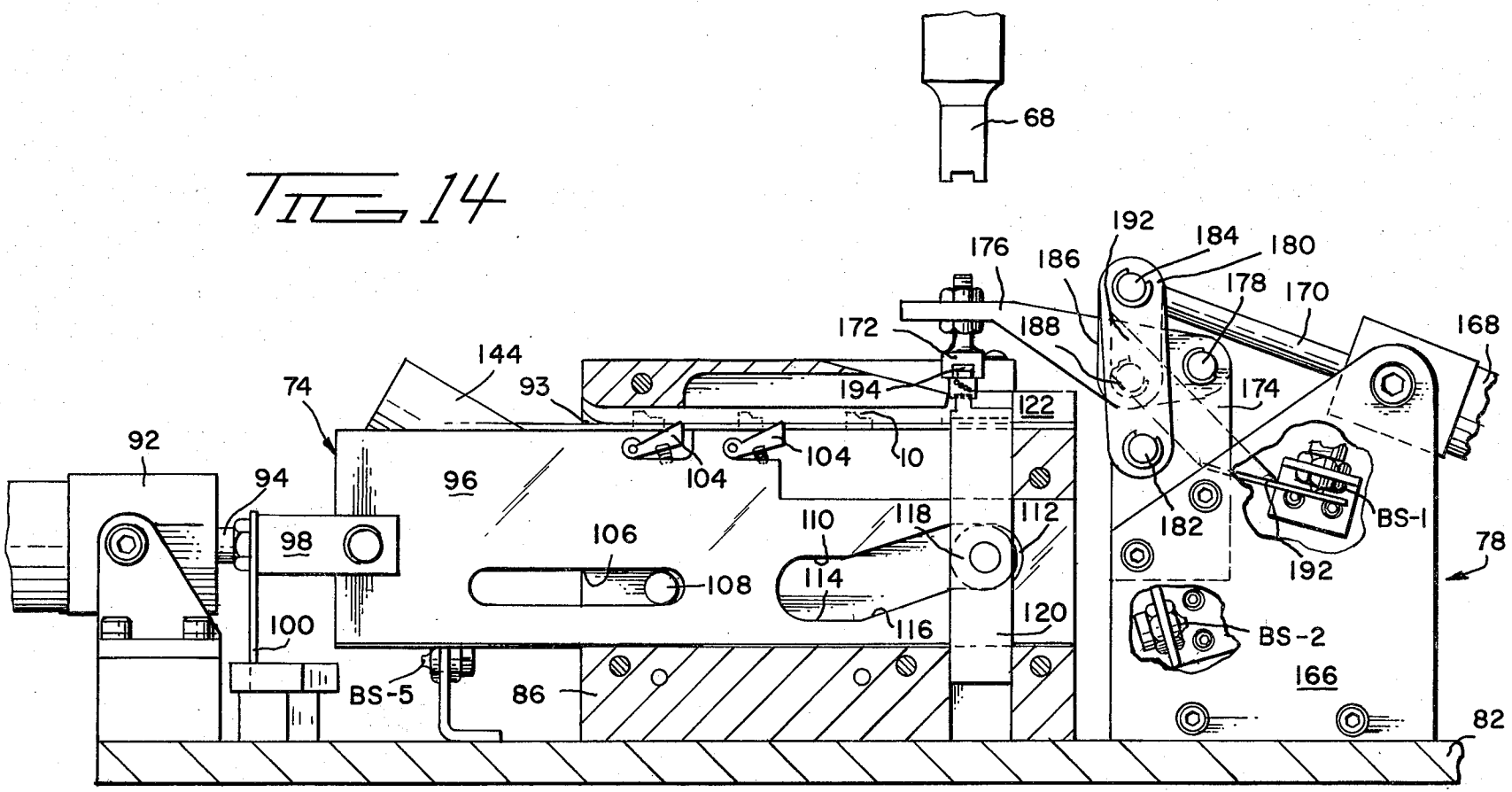
FIG. 14 is a side view taken along lines 14—14 in FIG. 13 showing the feed and plug clamp units.

Feed unit 74 is shown in FIG. 14 looking at one side as indicated by lines 14—14 in FIG. 13. This drawing also shows the plug clamp unit which will be discussed below.

The feed unit includes air cylinder 92 and shaft 94 which is connected to the piston (not shown) inside the cylinder. Feed plate 96 is attached to the shaft by yoke 98. Yoke 98 carries a sensor contact blade 100 which strikes bleed sensor BS-5 mounted on base 82.

Feed plate 96 is supported by the slots in the end walls.

The top edge of plate 96 has two pawls 104 which are pivotedly attached at one end and biased upwardly at their leading end by means of springs as shown.

There are two slots in the body of the slide. The first straight slot 106, has a pin 108 extending normally through it to limit the slides longitudinal or axial travel and to restrain any tendency thereof to move vertically. The pin is attached to the side walls of the structure. The second slot, indicated by reference numeral 110, has a forward horizontal section 112, a rearward horizontal section 114 and a ramp 116 connecting the two horizontal sections. As seen in the drawing, the forward section is displaced vertically upwardly relative to the rearward section. A roller 118 rides in this second slot.

A further member of the feed unit is elevator member 120 which is attached to roller 118 and moves vertically in structure 84. As plate 96 moves forward, roller 118 is forced down the ramp to the rearward section 114. Elevator member 120 is moved down. Conversely, as the plate is withdrawn, the elevator member is moved upwardly to the position shown in FIGS. 14 and 3 through 10.

The final major member of feed unit 74 is stationary blade 122 which is mounted on the structure above carrier strip track 93 (FIG. 3). The blade, as noted above, has its cutting edge on the bottom so as to sever cap 110 from its carrier strip as the elevator member raises the cap.

The function of feed unit 74 is three fold: advancing caps 10 and carrier strip 14 by means of plate 96; severing the caps from the strip by cooperation between elevator member 120 and blade 122; and elevating the caps and supporting them via member 120 during the several subsequent steps.

Figure 15:
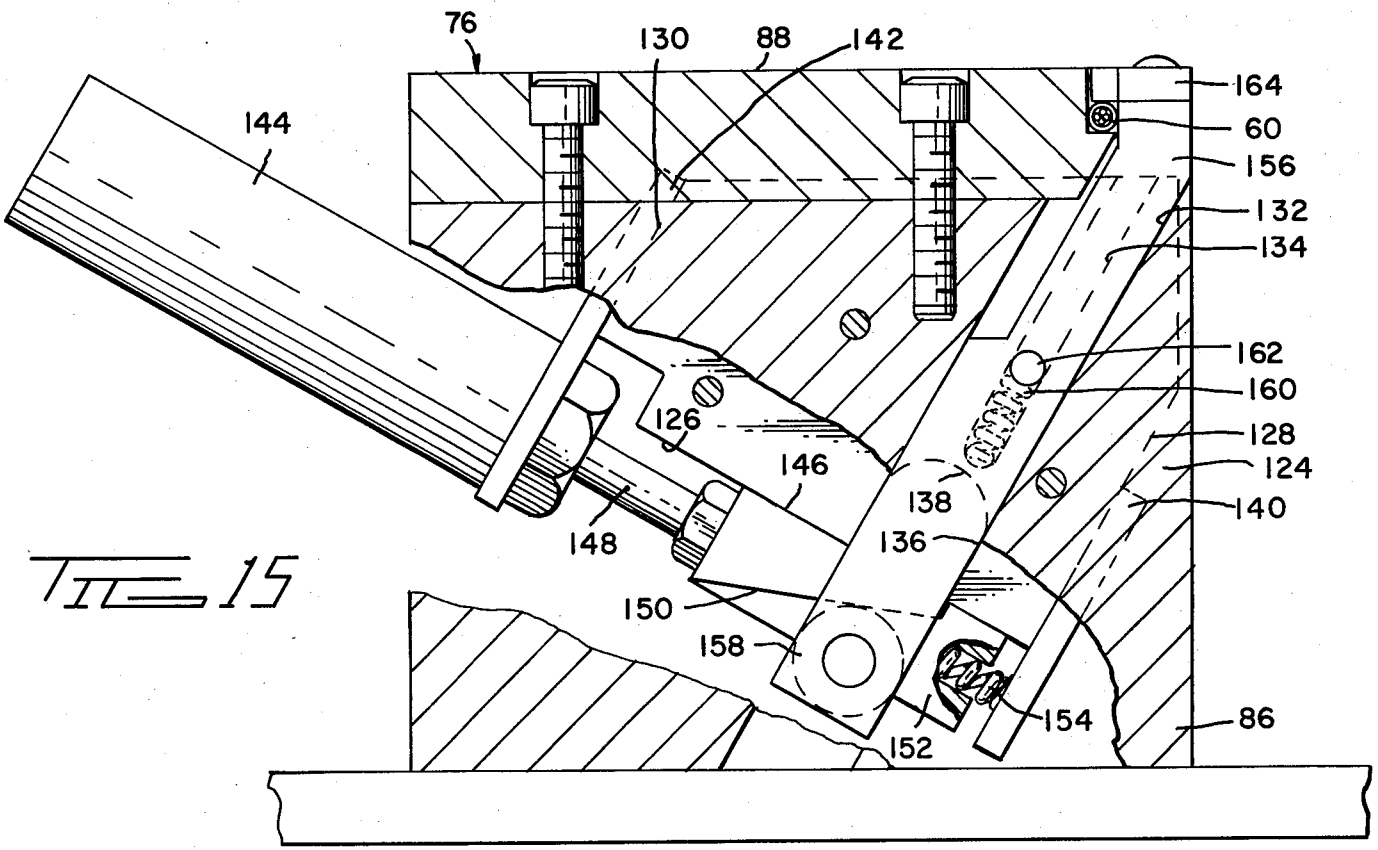
FIG. 15 is a side view of the wire clamp unit taken along lines 15—15 in FIG. 13.

The wire clamp unit 76 is shown in FIG. 15. The basic structural piece is a very thick block 124 shown partly in phantom in the drawing. This block is attached to a side wall of structure 84 (see FIG. 13). The lower edge 126 of the block is at an angle relative to the horizontal as is the lower section of front end 128 and all of the back end 130.

A large groove 132 has been milled out of the surface of the block facing the reader. This groove angles down from the upper right hand corner to lower edge 126. A smaller groove 134, shown in phantom, is located in the upper section of groove 132. A recess has been milled out at the bottom of groove 132 to provide, a round, downwardly facing shoulder 138. Two plates, 140 and 142, are secured to ends 128 and 130 respectively of the block by screws (not shown).

Air cylinder 144 is fixed to block 124 through plate 142 via conventional means. The air cylinder piston moves wedge member 146 reciprocally along lower edge 126 via piston shaft 148.

Wedge member 146 is a rectangular block of material with one side milled out to provide a ramp 150, shown in phantom in the drawing. This ramp extends from the rear end of the wedge member; i.e., adjacent its attachment to shaft 148, forwardly for about two-thirds the length of the member. The front end of the wedge member has a bore 152 from which protrudes coil spring 154.

An elongated member 156 is slidably positioned in large groove 132 with its upper end extending outwardly from the upper right hand corner of the block.

A roller 158 is attached to the lower end of the member which extends below the lower edge 126 of the block.

A coil spring 160 is positioned in small groove 134. A pin 162, fixed to and extending laterally from member 156 abutts the top of the spring. Compressing it whenever the member is moved down large groove 132.

The top of member 156 has a plate fastened thereto. This plate has a finger projecting forwardly therefrom (see FIG. 4). The finger and plate constitutes wire clamp 164.

Bleed sensor-6 (not shown) is positioned to be tripped by member 156.

The function of wire clamp unit 76 is to hold cable 60 firmly in place in the wire support area during the assembly of plug 70 and terminating of wires 62 therein.

The next unit to be discussed is the plug clamp unit 78 which is shown in a side view in FIG. 14. A pair of vertical, parallel plates 166, fixed to base 82, support the several parts that comprise the unit. A piston air cylinder 168 drive the linkage via piston shaft 170 that raise and lower pressure pad 172. A mounting block 174, secured to the plates in the upper left hand corner, pivotally supports arm 176 to which pad 172 is attached. The pivot point is indicated by reference numeral 178. The block further pivotally supports a parallel pair of major links 180, one link on either side of the block. That pivot point is indicated by reference numeral 182. The major links are also pivotally connected to shaft 170 at pivot point 184.

A pair of minor links 186 are pivotally connected to pivot point 184 at one end and to arm 176 at their other end, one link on either side of the arm. The pivot point on the arm is indicated by reference numeral 188. The arm, as seen in FIG. 14, thickens in the vicinity of pivot point 188 to accommodate it.

The combination of links and pivot points result in arm 176 revolving about pivot point 178 in response to reciprocal movement of air cylinder shaft 170.

A pair of spaced-apart sensors, BS-1 and BS-2, are located on the far plate 166, as shown in the cut-outs in the drawing. A sensor blade 192, fixed to arm 176 at pivot point 188, travels between and contacts the two sensors as the arm is rotated.

Pad 172 has a downwardly facing notch 194 in its base which fits over base 12 of the plug, straddling latch 46.

The function of plug clamp unit 78 is to hold the plug 70 in place while terminals 50 are being inserted and while the free ends of wires 62 are being severed (FIGS. 6–10).

Figure 16:
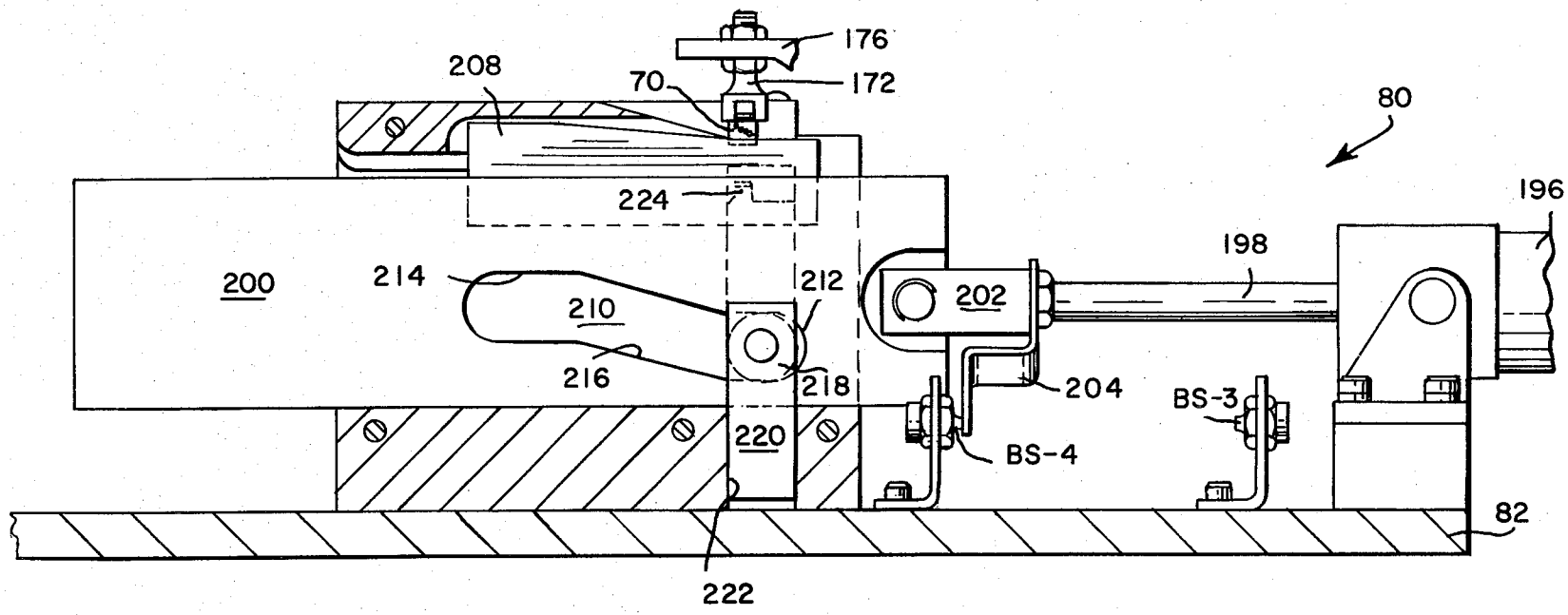
FIG. 16 is a side view of the inserter-trim unit taken along lines 16—16 in FIG. 13.

The final unit of machine 72 is inserter-trim unit 80, shown in FIG. 16; a view showing, one side thereof.

The unit includes air cylinder 196, piston shaft 198 and trim slide plate 200. A yoke 202 connects the plate to the shaft. Also connected to the shaft-yoke is a sensory blade 204 which travels between and contacts sensors BS-3 and BS-4 mounted on base 82. The plate is supported by slots in the structure end walls (not shown).

Plate 200 is a rectangular, flat plate and has trim blade 208 mounted on its upper surface near the end attached to yoke 202. The cutting edge of the blade is on top thereof which is angled as shown in FIGS. 8–10 and 16. A slot 210 is located in the plate below blade 208. This slot has a forward horizontal section 212, a rearward horizontal section 214 and a ramp 216 joining the two. Roller 218 rides in slot 210.

Roller 218 is fixed to anvil member 220 which rides up and down groove 222 in housing side wall 86. An anvil 224 is on top of the member which is moved vertically in response to the sliding motion of blade 200 by means of roller 218 riding in slot 210. As the member moves up, anvil 224 abutts and fully inserts terminals 50 into plug 70. Simultaneously, blade 208 is cutting across the front of plug 70 severing wires 62 as herein before described.

One piece of equipment which has not been explained nor shown is that which performs the function of welding cap 10 and base 12 together by ultra-sonics. Ultrasonic welding equipment is commercially available from several manufacturers. That one used with machine 72 is made by Branson Corporation and is Model No. 160P/401L.

Figure 17:
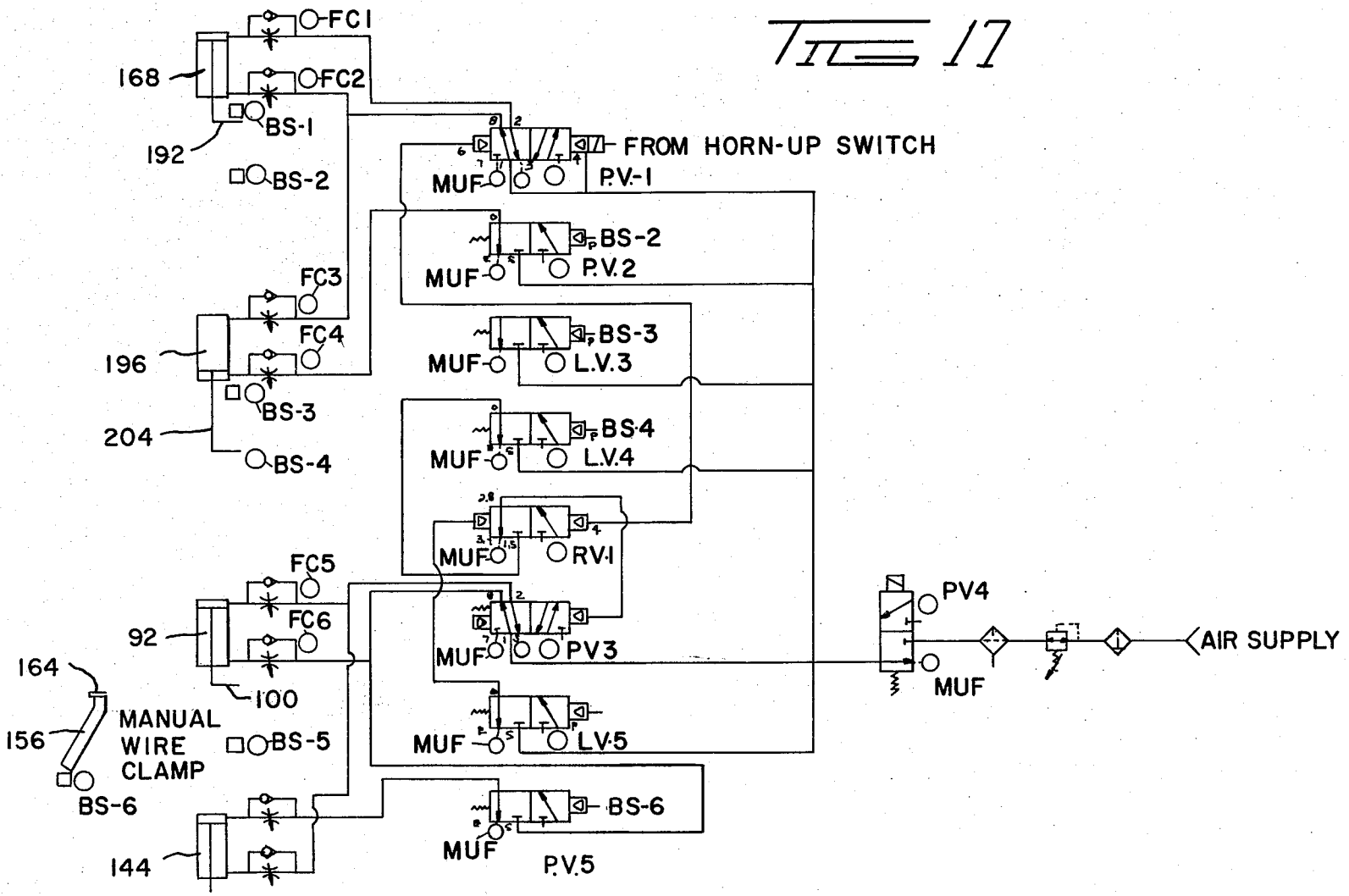
FIG. 17 is a schematic showing air cylinders, sensors and valves which operates the several units of the machine of the present invention.

Through out the above description references were made to several sensors. These are bleed sensors (BS) which send signals to air valves to actuate air cylinders and other valves. Attention is now directed to FIG. 17 which is a schematic of the sensors, air valves and air cylinders. The sensors are shown in association with their respective air cylinders and also are noted adjacent the air valve to which they connect.

The sequence of steps as discussed with reference to FIGS. 2 through 10 began with the step of advancing a cap 10 to the work area (FIG. 2). However, the preferred sequence begins with manually laying cord 60 and its wires 62 across wire support area and a cap already positioned on raised elevator member 120 and then manually depressing wire clamp 164 (FIGS. 4 and 5). Member 156 trips BS-6 (FIG. 17) which opens PV-5 (pneumatic valve). PV-5 sends air to extend air cylinder 144. This causes wedge member 146 to move into blocking engagement with roller 158 to hold the wire clamp in its depressed position (FIGS. 4–9 and 15).

The operator now dresses the individual wires along the grooves in the cap, using comb 90 (FIG. 4). Next a base 12 is placed into the lower end 68 of the horn (FIG. 5) and the operator then presses two palm buttons (not shown) simultaneously. The horn moves down to place the base onto the cap and ultra-sonically welds the two together to form plug 70. The wires and cord are secured within (FIGS. 6 and 7).

Figure 8:
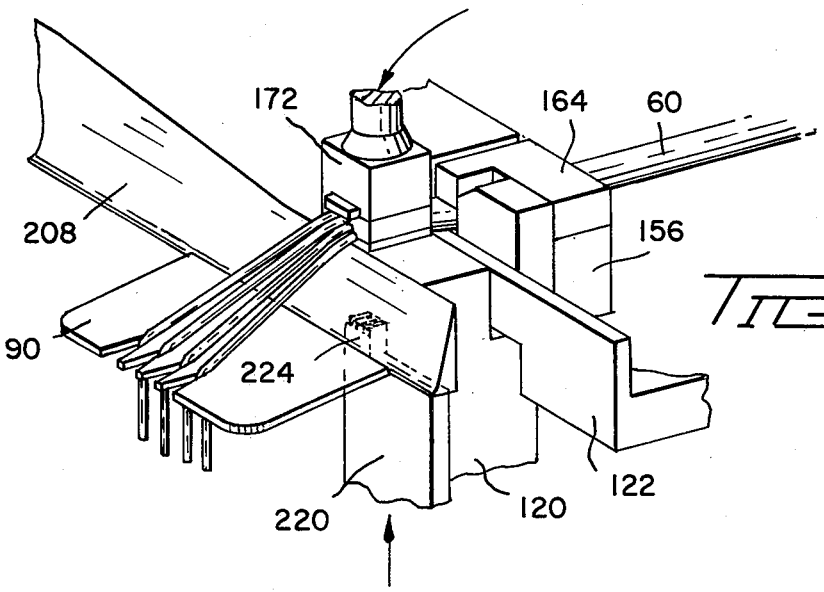

As the horn raises, a signal from a "horn-up" switch (not shown) signals PV-1. PV-1 sends air to extend the piston in air cylinder 168 (the cylinder in plug clamp unit 78). This causes arm 176 to swing about so as to clamp the plug in place with its pressure pad 172 (FIGS. 8 and 14). Concurrently, blade 192 associated with cylinder 168 moves from BS-1 to BS-2. Contact with BS-2 sends a signal to open PV-2 causing the piston in air cylinder 196 to retract (the cylinder in inserter-trim unit 80).

As the piston retracts, it pulls plate 200 to the right (FIG. 16). In so moving, trim blade 208 is brought across the front of plug 70 cutting off the ends of wires 62 protruding therefrom (FIG. 9). At the same time roller 218, riding in slot 210, is raising member 220-anvil 224 to fully insert terminals 50 into the wires in the plug 70 (FIGS. 9 and 11).

As the piston in cylinder 196 retracts, blade 204 associated therewith releases BS-4. This causes LV-4 (limit valve) and RV-1 (relay valve) to exhaust. With the piston retracted, blade 204 contacts BS-3 which causes LV-3 to open so that PV-1 shifts and RV-1 opens.

With the shift in PV-1, the piston cylinder 168 retracts which pulls arm 176 pressure pad 172 away from plug 70. The shift of PV-1 also causes the piston in cylinder 196 to extend, moving plate 200 to the left.

Anvil 224 moves down and trim blade 208 also moves to the left away from the front of plug 70 (FIG. 10).

As the piston in cylinder 168 retracts, blade 192 releases BS-2 which causes PV-2 to exhaust.

As the piston in cylinder 196 extends, blade 204 releases BS-3 to exhaust LV-3. When the blade contacts BS-4, LV-4 is opened through RV-1 which causes PV-3 to shift.

The shift in PV-3 retracts the piston in air cylinder 144 and extends the piston in cylinder 92.

The retraction in cylinder 144 pulls wedge member 146 out of blocking engagement with roller 158 (FIG. 15). This allows spring 160 to push member 156-wire clamp 164 up out of the way of cord 60 so that plug 70 and the cord may be removed from the work area (FIG. 12). As member 156 moves up, it releases BS-6 which causes PV-5 to close.

As the piston in cylinder 92 extends, it pushes feed plate 96 towards the right (FIG. 14). The pawls 104 pushes the leading cap 10 forward into the work area. Concurrently, roller 118, riding in slot 110, lowers elevator member 120 (FIG. 2).

When the piston has reached its end of travel, blade 100 associated therewith contacts BS-5. BS-5 causes LV-5 to open which exhausts RV-1 so that PV-3 shifts back causing the piston in cylinder 92 to retract. Further PV-5 is re-powered.

As the piston retracts it pulls feed plate 96 to the left Pawls 104 ride under the waiting caps 10 by reason of the coil springs. Elevator member 120 is raised back up by means of roller 118 riding in slot 110. As it rises, it picks up the cap in the work area and elevates it past the stationary knife blade 122 which severs the cap from carrier strip 14 (FIG. 3). This completes the cycle.

FIG. 17 also shows flow controls (FC) to regulate air flow to and from the air cylinders, mufflers (MUF) on the valves to silence the air being exhausted from them and a valve (PV-4) in the air supply line.

The present invention may be subject to many modifications and changes without departing from the spirit or essential characteristics thereof. The present embodiments are therefore to be considered in all respects as illustrative and not restrictive of the scope of the invention.

What is claimed is:

1. A machine for assembling a cap with partially inserted terminals and a base to form a modular telephone plug and to terminate a plurality of wires therein, said machine comprising:

a. a base structure having support means thereon to support first and second parallel plates for reciprocal movement horizontally therethrough, and further having two vertical support means, one to support an elevating member and another to support an anvil member for reciprocal movement vertically, said structure further having track means on which 2 cap-carrying carrier strip may be moved and further having a wire support station across which wires may be laid;

b. a feed unit comprising a rectangular first parallel plate slidably positioned in said structure with power means to slide said plate back and forth, said first parallel plate having at least one cap-engaging pawl on its upper edge and a slot with an angled section therein located adjacent one end, said feed unit further including an elevating member slidably positioned in one of said vertical support means and having a roller laterally connected thereto, said roller being movably positioned in the slot so that as the first parallel plate moves back and forth the reciprocating movement causes the elevating member to move vertically in the one vertical support member, so that as said first parallel plate and at least one pawl advances a cap, said elevating member elevates it up to in front of said wire support station, said elevating member providing a work station on which the cap is positioned;

c. a wire clamp unit attached to the base structure and comprising first a stationary support plate having thereon a generally vertical trending groove, an elongated member slidably positioned in the groove with wire clamping means on the top end and with a roller adjacent the lower end, and secondly a wedge member fixed to power means which removably drives the wedge member into blocking engagement with said roller to hold said wire clamping means against wires which may be positioned across the wire support station;

d. bonding means for bonding a base to the cap which may be positioned on the elevating member with wires projecting forwardly from the wire support station being positioned therein between thereby forming a modular telephone plug;

e. a plug clamp unit having an arm with a plug clamping pad at its free end and pivotally connected at its other end, a shaft connected to power means for reciprocating the shaft, link means connecting the shaft to the arm whereby the reciprocating of the shaft rotates the arm, said unit adapted to removably hold a plug which had been formed by said bonding means;

f. a trim-insertion unit comprising a rectangular second parallel plate slidably positioned in said structure with power means to slide said plate back & forth, said second parallel plate having a trim blade on its upper edge and an elongated slot with an angled section therein located adjacent one end, said trim-insertion unit further including an elongated. anvil member having anvil means on its upper surface and being slidably positioned in (another of said) the other vertical support means, said anvil member having a roller connected thereto with the roller being movably positioned in the slot so that as the second parallel plate moves back and forth, the reciprocating movement causes said anvil member to move vertically in said other vertical support member, said trim blade adapted to trim the wires which may be extending from the plug and the anvil means (may) adapted to fully insert the partially inserted terminals positioned in the cap.

2. The machine of claim 1 wherein said power means include piston-containing air cylinders.

3. The machine of claim 2 further including movable contact blades connected to the pistons of said air cylinders and a plurality of sensing means positioned in the line of travel of the contact blades and adapted to regulate air flow to and from said cylinders by and upon being contacted by the moving contact blades.

* * * * *